US008870163B2

(12) United States Patent
Regan

(10) Patent No.: US 8,870,163 B2
(45) Date of Patent: Oct. 28, 2014

(54) BRACKET SYSTEM AND METHOD

(75) Inventor: John E. Regan, Walnut Creek, CA (US)

(73) Assignee: John E. Regan, Walnut Creek, CA (US)

( * ) Notice: Subject to any disclaimer, the term of this patent is extended or adjusted under 35 U.S.C. 154(b) by 139 days.

(21) Appl. No.: 13/071,811

(22) Filed: Mar. 25, 2011

(65) Prior Publication Data

US 2012/0241703 A1 Sep. 27, 2012

(51) Int. Cl.
*E04H 17/00* (2006.01)
*E04F 11/18* (2006.01)

(52) U.S. Cl.
CPC ..... *E04F 11/181* (2013.01); *E04F 11/1817* (2013.01); *E04F 11/1812* (2013.01)
USPC ..... 256/65.02; 256/65.03; 248/534; 52/298

(58) Field of Classification Search
USPC ..... 248/518; 52/298, 702, 713; 256/65.03; 403/233, 231
See application file for complete search history.

(56) References Cited

U.S. PATENT DOCUMENTS

| | | | | | |
|---|---|---|---|---|---|
| 844,726 | A | * | 2/1907 | Hunter | 111/99 |
| 2,667,317 | A | * | 1/1954 | Trebules | 248/514 |
| 2,820,262 | A | * | 1/1958 | Dunn | 52/298 |
| 4,260,277 | A | | 4/1981 | Daniels | |
| 4,285,542 | A | | 8/1981 | Boisvert | |
| 4,359,851 | A | | 11/1982 | Daniels | |
| 4,594,017 | A | * | 6/1986 | Hills | 403/6 |
| 4,644,713 | A | * | 2/1987 | Lehman | 52/165 |
| 4,689,889 | A | * | 9/1987 | Reeves | 33/408 |
| 5,150,982 | A | | 9/1992 | Gilb | |
| 5,219,105 | A | * | 6/1993 | Kravitz | 224/511 |
| 5,374,024 | A | * | 12/1994 | Williams | 248/514 |
| 5,568,909 | A | * | 10/1996 | Timko | 248/519 |
| 5,771,646 | A | * | 6/1998 | DeSouza | 52/263 |
| 5,901,525 | A | * | 5/1999 | Doeringer et al. | 52/835 |
| 6,336,620 | B1 | * | 1/2002 | Belli | 248/519 |
| 6,378,819 | B1 | * | 4/2002 | Johnson | 248/214 |
| 6,471,192 | B1 | * | 10/2002 | Erwin | 256/65.05 |
| 6,474,522 | B1 | * | 11/2002 | Johnson | 224/515 |
| 6,484,987 | B2 | * | 11/2002 | Weaver | 248/278.1 |
| 6,719,481 | B2 | * | 4/2004 | Hoffmann | 403/403 |
| 6,817,157 | B2 | | 11/2004 | Bourque | |
| 6,868,641 | B2 | * | 3/2005 | Conner et al. | 52/98 |
| 6,886,296 | B1 | * | 5/2005 | John et al. | 52/170 |
| D507,352 | S | * | 7/2005 | Vanderbrugghen | D25/42 |
| 6,929,227 | B2 | * | 8/2005 | Hofmann et al. | 248/224.8 |
| 7,140,702 | B2 | * | 11/2006 | Byron et al. | 312/296 |
| 7,261,264 | B2 | * | 8/2007 | Moran | 248/222.11 |
| 7,377,491 | B2 | * | 5/2008 | Fuoco | 256/65.03 |

(Continued)

*Primary Examiner* — Terrell McKinnon
*Assistant Examiner* — Daniel Breslin
(74) *Attorney, Agent, or Firm* — Quinn Law Group, PLLC.

(57) ABSTRACT

A bracket system for connecting a structural member to an upright member includes a bracket having an attachment portion configured to be operatively attached to a vertical or side surface of the structural member and a cup portion integral with the attachment portion. The cup portion includes a base portion and an interior perimeter surface configured to receive the upright member in an installed position such that the exterior perimeter surface of the upright member is proximate to the interior perimeter surface of the cup portion and the upright member is supported in an orientation which is substantially perpendicular and parallel to the structural member. The bracket may include an adjustable member received through a bracket opening and adjustable to retain the upright member in or allow removal of the upright member from the bracket. The upright member may include a reinforcing face plate interfacing with the adjustable member.

23 Claims, 7 Drawing Sheets

(56) References Cited

U.S. PATENT DOCUMENTS

| | | | | |
|---|---|---|---|---|
| D610,717 | S * | 2/2010 | Lin | D25/133 |
| 7,740,220 | B2 * | 6/2010 | Jeanveau | 248/534 |
| 8,123,190 | B2 * | 2/2012 | Kost | 248/514 |
| 8,141,830 | B1 * | 3/2012 | Hudson | 248/220.1 |
| 8,141,839 | B2 * | 3/2012 | Buchner | 248/516 |
| 8,146,879 | B2 * | 4/2012 | Liao | 248/514 |
| 8,231,035 | B1 * | 7/2012 | Michael et al. | 224/403 |
| 8,245,481 | B1 * | 8/2012 | Flynn | 52/741.11 |
| 2007/0108364 | A1 * | 5/2007 | Metheny | 248/541 |
| 2009/0314910 | A1 * | 12/2009 | Jeanveau | 248/231.71 |
| 2011/0260029 | A1 * | 10/2011 | Kost | 248/514 |
| 2011/0290965 | A1 * | 12/2011 | Virgin | 248/205.3 |

* cited by examiner

BRACKET SYSTEM AND METHOD

TECHNICAL FIELD

The present invention relates to a bracket system and method of use.

BACKGROUND

Rail posts used to construct railings for structures such as decks, balconies, etc. must withstand loading. In a typical configuration, the post may be attached to a structural member, for example, a rim joist, using one or more bolts which extend partially or fully through the post and the structural member. The post may provide a lever action that can intensify the force, e.g., the loading the post itself exerts at the attachment point. The railing, and the posts comprising the railing, may be subject to other loading forces which may include leaning loads during normal use and intermittent loading which may be severe. An example of the latter is impact loading of the railing from snow sliding off roofs during the winter season.

The rail posts used to construct railings on structures such as decks, balconies, etc., may be notched prior to assembly to the horizontal structural member, for example, the rim joist of a deck. The notch in the rail post may significantly weaken the strength properties of the posts. Checks or cracks may propagate along the grain lines at the notch as the material, typically lumber, of the post ages, dries and shrinks.

Other instability in the railing may occur over time, due to aging of the wood or other materials used to construct the railing and/or structure to which the railing is attached, expansion and contraction of the respective railing and/or structure which may result in weakening of the railing and/or loosening of the railing from the structure, which may result in the need to replace, repair, or reinforce the railing and/or the structure.

SUMMARY

A bracket system including a bracket for connecting a structural member to an upright member adjacent to the structural member is provided. The bracket may include at least one attachment portion configured to be operatively attached to a surface of the structural member such that the attachment portion may be parallel to a vertical surface of the structural member. The bracket may include two or more attachment portions, where the attachment portions may be co-planar or may be perpendicular to each other. The bracket may further include a cup portion integral with the attachment portions, the cup portion including a base portion and defining an interior perimeter surface or cup and configured to receive the upright member in an installed position. An exterior perimeter surface defined by the upright member may be proximate to the interior perimeter surface of the cup portion of the bracket in the installed position, such that the cup portion supports the upright member in the installed position in an orientation which may be substantially perpendicular to and/or substantially parallel to the adjacent structural member.

The upright member may include a face plate operatively attached to a post member. The face plate may be configured as a reinforcement element to strengthen the upright member. The post member and/or the face plate may define an interface surface. An adjustable member received through an opening in the bracket cup portion may be adjusted from a first position to a second position in operative contact with the interface surface to stabilize and/or retain the upright member in the bracket. The adjustable member may be adjusted to the first position from the second position to allow removal of the upright member from the bracket.

In a non-limiting example, the upright member may be a railing post configured for use in a deck railing or stair railing for installation to a deck structure, and the structural member may be configured as one of a deck joist or stair stringer. A deck railing utilizing the bracket system and rail posts as described herein may be configured to be easily adjusted during its useful life in the installed position to compensate for wear, warpage, etc. which may cause loosening or instability of the railing, and readily removed for seasonal storage, maintenance, etc. using the adjustment feature of the bracket system provided herein. The configuration of the upright post, including the face plate, provides a rail post of increased strength to resist shear loads encountered during use, which may include snow loads and leaning loads. The face plate cooperates with bracket configuration including the adjustable feature during stabilization, retention and removal of the upright member.

The above features and other features and advantages of the present invention are readily apparent from the following detailed description of the best modes for carrying out the invention when taken in connection with the accompanying drawings.

DETAILED DESCRIPTION

Figure 1:
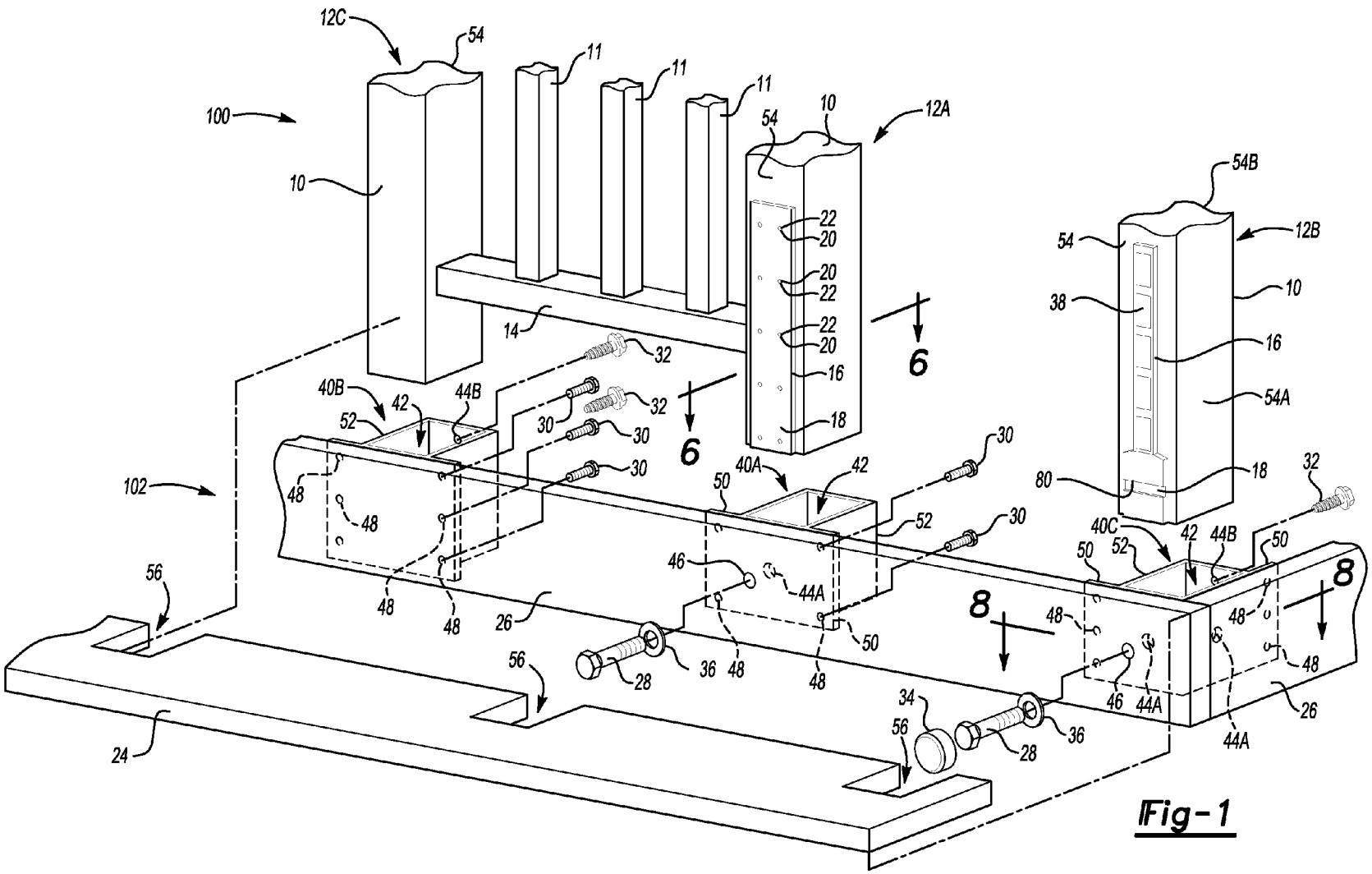
FIG. 1 shows a schematic perspective exploded partial view of a system for interconnecting a deck and a post using a bracket.

A bracket system is provided to support a vertical or upright member, such as a post, on a bottom surface and around the perimeter of the vertical member so as to retain the vertical member in a generally upright position without additional attachment. In a non-limiting example, the bracket is configured with attachment flanges to operatively attach the bracket to a beam or a joist of a deck, to provide support for a vertical member configured as a post such as a rail post for a deck railing. The attachment portions of the bracket may be co-planar flanges which may be operatively attached to a flat surface, or may be perpendicular to each other such that the bracket may be operatively attached to the surfaces of two joists forming a corner of the deck structure, for example.

The bracket system may be further configured with an adjustable member, which may be adjustable to exert a force on the upright member to remove clearance between the upright member and the interior surface of the bracket, and/or to place the exterior surface of the upright member in proximate contact with at least a portion of the interior surface of the bracket. The bracket system may be configured such that the adjustable member is movable from a first position to a second position, and vice versa. In a first position, the adjustable member may be proximate to, but not in contact with, the upright member. For example, the adjustable member may be engaged in a threaded hole in the bracket such that the end of the adjustable member, in the present example, a fastener, remains flush with the interior surface of the cup portion of the bracket, thereby not contacting the vertical (upright) member. When the adjustable member is selectively moved to the second position, it may be proximate to or in operative contact with the vertical member. The adjustable member in the second position cooperates with the vertical member to resist removal of the vertical member from the bracket, for example, by interfering with the vertical member or by using the frictional force resultant from the contact between the adjustable member and an interfacing surface of the vertical member. The adjustable member may be movable from the second position to the first position, to allow removal of the vertical member from the bracket after initial installation or reinstallation, e.g., after adjusting the adjustable member to the first position.

An opening defined by the bracket may be configured to receive the adjustable member or a retaining member, which in a non-limiting example may be configured as a fastener. The adjustable (retaining) member may be oriented to be outwardly facing, e.g., accessible for adjustment and/or installation from an exterior or outwardly facing (generally visible in an installed position) portion or surface of the structure for easy or ready accessibility for adjustment, installation, removal, and/or maintenance of the bracket system and/or posts 12 retained thereby. The adjustable retaining feature may be oriented to be inwardly facing, e.g., accessible for adjustment and/or installation from an interior or inwardly facing (generally not visible in an installed position) portion or surface of the structure, such that the brackets and/or fastening elements (retaining members) are not visible from an exterior or outwardly facing portion of the structure, e.g., the portion generally visible or viewable in an installed position.

The vertical or upright member may include a strengthening or reinforcement element, which in a non-limiting example may be configured as a face plate operatively attached to a surface of the vertical member to improve the stability and/or strength of the vertical member, and to provide an interface surface in operative contact with the retention member. The face plate may be configured to increase the column strength of the vertical member, thereby increasing resistance of the vertical member to impact and/or shear loads. In a non-limiting example provided herein, the vertical member may include a rail post member for a deck railing, to which a face plate is operatively attached to increase the column strength of the rail post.

A bracket is provided, which may be configured to be operatively attached to the structure to which the railing is installed, e.g., in the present example, the deck. The vertical member, referred to herein as the post, and the bracket are each configured such that the post may be supported in the bracket by the cup portion of the bracket and a bottom surface of the bracket, e.g., the base of the bracket, such that the post is retained in a generally upright position without further attachment to the bracket. The bracket may be configured with an opening to receive the adjustable retaining member, which may be adjusted to apply pressure against an interfacing surface of the post, to remove clearance between the exterior surfaces of the post and the interior surfaces of the cup portion of the bracket. The adjustable member may be positioned to provide sufficient force to resist removal of the post from the bracket, for example, by providing an interference fit with the post member or with the face plate.

A plurality of posts and brackets may be provided, wherein the posts are operatively attached to each other to define a railing, for example, a deck railing. The plurality of brackets may be operatively attached to the deck structure, and the railing is operatively attached to the deck via the plurality of posts and brackets. A railing thus configured provides a number of advantages, including a railing configuration which is removable and replaceable for seasonal use and/or for maintenance of the railing, the deck, or an adjoining structure such as a building to which the deck is operatively attached. The railing may be configured as a modular or sectional railing for easy installation and removal, for example, to provide access directly to the deck surface for the movement of larger objects onto and off of the deck surface, without the need to deconstruct and reassemble or rebuilt a section of, or the entire, railing. A railing configured with the bracket system described herein may be removed and readily stored, for example, during the winter season, when the deck is not in use, to avoid weathering of the railing and/or damage to the railing due to snow loads, which may introduce impact or shear loads to the railing due to snow sliding off roofs, etc.

The railing may be tightened and/or adjusted as the posts, connecting rails, supporting or interfacing deck structure, etc. wear, warp, age and/or weather, which may result in shrinkage, expansion, warpage and/or distortion of these components. The adjustability of the retention feature provides a means to compensate for these changes in the deck and railing components over time, to take out wobble or instability in the deck railing by taking up excessive clearance between the railing post and the bracket into which the railing post is set, or to compensate for changes in the relative position of the post and the deck, for example, due to sagging or shifting of the deck structure. Thus configured, the retention feature may be used to adjust the post position within the bracket in a horizontal and/or vertical direction.

The full cross-sectional strength of each post may be retained, as the bracket system does not require notching the post or drilling holes through the full cross-section of the post for lag bolts or other mounting hardware and may not require any modification of the post or post material during installation to the bracket. Further, the use of a face plate or reinforcement member as part of the bracket system provides additional strength to the rail post, in particular column strength resistant to shear loads imposed on the post during use, which may be ordinary use, such as leaning loads by objects leaning on the deck rail, or may include high magnitude impact loading, for example, from falling snow load or other objects impacting the rail at greater than nominal velocities.

Referring to the drawings wherein like reference numbers represent like components throughout the several figures, the elements shown in FIGS. 1-10 may not be to scale or proportion. Accordingly, the particular dimensions and applications provided in the drawings presented herein are not to be considered limiting. As used herein, the terms "vertical" and "horizontal" refer to the orientation of the element or feature with respect to its as-installed position, which will typically be in reference to the ground or a floor or decking of a structure, where the floor or decking generally define a horizontal plane.

FIG. 1 shows a schematic perspective exploded partial view of a deck 102 and a railing 100 interconnected using the bracket system described herein. The example shown in FIG. 1 is intended to be non-limiting, and it would be understood that the bracket system disclosed herein may be used to interconnect structural elements in other configurations. The railing 100 may also be referred to as a removable object, and the deck 102 may also be referred to as a structure or support structure. The example shown in FIG. 1 is intended to illustrate alternative configurations of the bracket system, therefore it would be understood that any combination of one or more of the configurations of bracket systems (brackets, fasteners and posts) may be used in the construction of a structure, as required by the specifications and configuration of the structure itself.

The railing 100 may generally includes a plurality of rail post assemblies 12, which may each be referred to as a post 12 including at least a post member 10. The post 12 may also be referred to as a removable member, a vertical member, and/or an upright member. The railing 100 may include a rail 14 configured to interconnect the plurality of posts 12. The rail 14 may be of a continuous length sufficient to interconnect a number of posts 12, or may, as shown in FIG. 1, consist of a plurality of rail members or sections 14, which each may be configured to interconnect two adjacent rail posts 12. The rail 14, as shown in FIG. 1 is configured as a lower, or bottom, rail. It would be understood that one or more additional rails, including for example, a top or upper rail, may be used to interconnect the posts 12. A plurality of balusters 11 may be spaced or distributed between adjacent posts 10, and operatively connected to one or more rails 14.

In a non-limiting example, the railing 100 may be assembled, e.g., installed to the deck 102 by installing the plurality of posts 12 to the plurality of brackets 40. Each post 12 may be installed in a bracket 40 by inserting the end of the post 12 into a cup 42 defined by the bracket 40, such that the post 12 is retained in a generally upright (vertical) position. Installing the post 12 in the bracket 40 may include operatively attaching the post 12 to the bracket 40 using one or more fasteners 32, 28 to retain the post 12 in the bracket 40 and/or adjust the position of the post 12 in the cup 42. The bracket system, e.g., one or more of the post 12, post plate 16, bracket 40 and fasteners 32, 28 may be configured and arranged such that the post 12 is easily removable from the bracket 40, e.g., readily disassembled from the deck 102 for seasonal storage, maintenance, etc. The bracket system may be configured such that the post 12 is not modified during installation, e.g., the post 12 may be retained in the bracket 40 without notching, drilling holes, installing fasteners, etc. to the material comprising the post 12, etc., such that the integrity and strength of the post 12 may not deteriorated or affected by installation to the deck 102.

The railing 100 may be constructed and/or assembled in one or more sections or modules prior to installing the posts 12 into the brackets 40, such that two or more posts 12 may be operatively attached to each other and concurrently installed into corresponding brackets 40 during assembly of the railing 100 to the deck 102. The posts 12 may be individually installed in the brackets 40 prior to constructing or assembling the railing 100, e.g., the railing elements such as the rail members 14 may be operatively attached to the posts 12 after the posts 12 have been assembled to the deck 102. Other assembly sequences are possible, for example, the posts 12 may be inserted in the cup portions 42 of the brackets 40 and aligned with respect to the deck surface and/or another post 12, then retained in the aligned position by the adjustable retention member 28, for example, while constructing the railing 100 using the posts 12. This method may be used to optimize the fit between the railing 100 and the deck 102. After construction of the railing 100, the adjustable members 28 may be adjusted such that the railing 100 may be temporarily removed, for example, for further processing of the railing 100, such as finishing (staining, painting, etc.), installation of balusters 11, etc. The finished railing 100 may then be reinstalled and the adjustable members 28 adjusted such that the railing 100 is operatively attached to the deck 102 until removal at a future time (for maintenance, seasonal storage, etc.) may be required.

The post 12, which may also be described as a vertical member or as an upright member, includes at least a post member 10, as shown for post 12C in FIG. 1. At least one side of the post member 10 may be defined as a interfacing side or facing side 54, such that the facing side 54 is oriented when inserted into a bracket 40 to interface with the adjustment/retention feature of the bracket system. The post member 10 may include more than one interfacing side 54. For example, for the post 12B is configured as a corner post with interfacing sides 54, 54A, 54B, each of which may interface with an adjustment/retention feature of the bracket 40C. The post 12 may include a face plate 16, which may also be referred to as a plate or reinforcing member, as shown by way of non-limiting example for posts 12B and 12C. The post 12 may include a plurality of plates 16, for example, the post 12B may include a plate 16 on the interfacing side 54 and may include a second plate 16 on the interfacing side 54A. The face plate 16 may be operatively attached to the facing side 54 the post member 10, such that the face plate 16 is positioned to interface with the adjustment/retention feature when the post 12 is inserted into the bracket 40. The face plate 16 may be operatively attached to the post member 10 by one or more plate fasteners 22, which may be in a non-limiting example, screws or other fasteners of a type generally known in the construction industry. The face plate 16 may include a plurality of openings (holes, slots, etc.) 20 to receive the plurality of plate fasteners 22. The face plate 16 may include an interface surface generally indicated at 18, configured to be in operable contact with an adjustment member 28 when the post 12 is positioned (installed) in the cup portion 52 of the bracket 40. The interface surface 18 may be a flat surface, as shown for post 12A, to which an adjustment member 28 may be selectively positioned in abutting contact. The interface surface 18 may be defined by other features, such as a slot 80 as shown for post 12B, wherein the slot 80 interferes with or resists the removal of the post 12 from the bracket 40 when the adjustment member 28 is selectively positioned in abutting contact with the interface surface 18, or sufficiently proximate to the interface surface 18 within the recess 84 so as to interfere with surface of the slot 80 when the post 12 is moved in a vertical direction. Other configurations of the interface surface 18 are possible, as will be described in further detail herein.

The post member 10 and the plate 16 may respectively be made of any suitable material, such that the combination of the post member 10 and the plate 16 provide a post 12 of sufficient strength to sustain the loads required by the application in which the post 12 is to be used. In the present non-limiting example, the post 12 may comprise materials of sufficient strength as required for a deck railing post. In the non-limiting example shown, the post member 10 may be configured of wood and may be of a cross-section which corresponds with a standard size reference within the construction industry, for example, the post member 10 may be made from a 4×4 post. It would be understood that the post size description of 4×4 corresponds to or indicates a wood post which has an actual cross-sectional area of approximately 3½"×3½."

The face plate 16, in a non-limiting example, may be made of a metal, such as aluminum or steel, and of a suitable size (horizontal width, vertical length, thickness) to provide the desired additional column strength to the post 12. Using the example of a 4×4 post which may be cut to approximately 4 feet in vertical length for use as a post member 10, the face plate 16 may be, by way of non-limiting example, a steel plate or strip approximately 3/16" thick, approximately 3¼" to 3½" wide and approximately 2 feet in vertical length. A post 12 consisting of a 3/16" plate 16 attached to a 4×4 (3½"×3½") post member 10 would have a generally rectangular cross-section of approximately 3½"×3 11/16." As will be described in further detail, the bracket 40 must be configured with a cup portion 52 having interior perimeter surface 42 defining a cross-sectional area with sufficient clearance to receive the post 12, e.g., for the insertion of the post 12 into the cup portion 52, and of sufficient depth to retain the post 12 in an upright or generally vertical position. In the example shown in FIG. 1, the interior perimeter surface 42, which may also be referred to as the cup, may be approximately 5" to 5½" deep, such that the cup portion 52 does not extend beyond the vertical mounting face of the joist when the bracket 40 is attached to a 2×6 inch joist. The depth (height) of the cup portion 52 (see CH in FIG. 2A) may be varied as required to provide vertical support to the post 12, and/or for various size joists or other structural members to which the bracket 40 may be attached.

Other sizes of the post member 10 could be used. By way of non-limiting example, the post member 10 may be a 4×6 (having a cross-sectional area of approximately 3½"×5½"), a 6×6 (having a cross-sectional area of approximately 5½"× 5½"), or of another size as may typically be used in the construction of deck structures. The post member 10 may be modified from a standard size to provide sufficient clearance for insertion into a cup portion 52 configured from standard components, such as channel or tubing, as described herein. In a non-limiting example, the post member 10 may be modified by tapering an end portion of the post member 10 to be inserted into the cup 42, to provide a tapered portion of sufficient length for insertion into cup 42. It would be understood that other sizes of the post member 10 may be used according to the requirements of the structure (which may be a non-deck structure) being configured. The post member 10 may be made of any suitable material, including wood, which may be pressurized or pretreated wood, wood composites, wood and plastic composites, plastic lumber, plastic, polymeric or polymeric composite materials, aluminum, steel, other metals or structural materials, etc.

The face plate 16 may vary in configuration and shape according to the requirements of the application. For example, the face plate 16 may be of any width narrower than the facing side 54 and sufficiently wide enough to provide an interface surface 18. The vertical length of the face plate 16 may be varied from the minimum length required to provide an interface surface 18, to any length which provides the desired column strength and/or reinforcement of the post member 10. By way of non-limiting example, the face plate 16 may have a vertical length of 2 to 4 feet, depending on the column strength specified for the post 12, for attachment to a post member 10 having a vertical length of 4 feet. The face plate 16 may be made of any suitable material or combinations of materials, including steel, aluminum, cast iron, wrought iron, other metals or structural materials, plastic, polymeric or polymeric composite materials, etc., and formed by any method suitable to the material used to make the face plate 16, including rolling, cutting, stamping, slitting, molding, casting, forging, etc. to provide, as required by the application in which the post 12 is used, at least one of an interface surface 18 and an improvement in the column strength of the post 12.

As described previously in a non-limiting example, and shown in FIG. 1 at post 12A, the face plate 16 may be operatively attached to the post member 10 by one or more fasteners. Other means may be used to operatively attach the face plate 16 to the post member 10 including but not limited to adhesives, rivets, nails, banding, etc. The fastening method may be provided by a feature integral to the plate 16. By way of non-limiting example, the plate 16 may be comprised of nail plate, punched metal plate and/or truss connector plate which may be attached to the post member 10 by hammering the protruding features of the nail plate etc. into the post member 10. The face plate 16 may be provided as an integral member or insert to the post 12, for example, the face plate 16 may be provided as an insert, which may be a metal insert molded into a polymer composite post member 10 to form the post 12.

The face plate 16 may be configured as a decorative element, as show for post 12B in a non-limiting example, such that the face plate 16 may be configured in a shape other than a plate or strip, wherein the decorative element may be derived from a shape, pattern, forming method such as etching, stamping, molding, casting, etc. An example of a decorative plate 16 may include wrought iron, grill work, grating, punched metal plate, expanded metal, etc., or may include a cast or molded element, which by way of non-limiting example, may include a plate 16 molded from a polymer, which may further include a metal or reinforcing insert to provide at least one of the interface surface 18 and/or increased column strength to the post 12.

The post 12, plate 16, and/or post member 10 may be partially or fully painted, stained, coated, plated, galvanized, phosphated, oxidized, black oxided, etc. or otherwise treated, for example, to increase resistance to weathering, aging, corrosion and/or deterioration due to environmental factors, and/or for decorative or appearance purposes. Additionally, the bracket 40, adjustable member 28 and other elements and/or fasteners which may be included in the bracket system as described herein, such as but not limited to washers 36, caps 34, and fasteners 28, 32, 30, may be partially or fully painted, stained, coated, plated, galvanized, phosphated, oxidized, black oxided, etc. or otherwise treated, for example, to increase resistance to weathering, aging, corrosion and/or deterioration due to environmental factors, and/or for decorative or appearance purposes.

The post 12 may be inserted into a bracket 40, wherein the bracket 40 is configured to retain the post 12 in a generally vertical or upright position, and such that the post 12 is generally perpendicular to the structural member 26 and/or parallel to the mounting face, e.g., the vertical or side face of the structural member 26 to which the bracket 40 is attached. FIG. 1 illustrates various non-limiting examples of post 12 and bracket 40 combinations which may be used for construction of a structure such as the deck 102 and the railing 100 installed thereto. The deck structure 102 may include a plurality of posts 12 and a plurality of brackets 40, such that each post 12 may be inserted into a corresponding or respective bracket 40 to construct the deck structure. As described previously, various configurations of the post 12 are possible including, but not limited to the posts 12A, 12B and 12C shown in FIG. 1. Various configurations of the bracket 40 are included within the scope of the bracket system described herein, including but not limited to the example configurations illustrated by brackets 40A, 40B, 40*c*, 40 D, 40E and 40F and the variations thereof described herein and/or shown in the figures.

The configuration of the deck 102 shown in FIG. 1 is not intended to be limiting, and it would be understood that the bracket system including at least one bracket 40 and at least one post 12 may be used with any configuration of deck 102 and/or other structure wherein a member such as a post 12 may be retained and/or attached using a bracket 40. By way of example, the deck 102 may include a plurality of joists and/or structural members 26, which may include one or more rim joists, floor joists, edge joists, blocking, fascia board, etc. which are joined by any suitable means to form the support structure of the deck 102. In the example shown, the joists 26 are oriented in the deck 102 such that the side of largest surface area of the joist 26 defines a generally vertical surface in the installed position. The deck surface may be formed by a plurality of deck boards 24, which may include edge caps, such as the edge cap 24 shown in FIG. 1. The deck members and structural members 24, 26 may be made of any suitable material, including wood, which may be pressurized or pretreated wood, wood composites, plastic, plastic lumber, polymeric or polymeric composite materials, aluminum, steel, other metals or structural materials, etc. The deck members and structural members 24, 26 may be painted, stained, coated, plated, galvanized, oxidized, black oxided, etc. or otherwise treated, for example, to increase resistance to weathering, aging, corrosion and/or deterioration due to environmental factors, and/or for decorative or appearance purposes.

The edge cap 24 may be notched or otherwise define one or more recesses 56 such that the edge cap 24 may be fitted in proximate contact with or adjacent to one or more posts 12, where each recess 56 is configured to fit around or at least partially surround the post 12. Thus configured, the bracket and associated attachment hardware, e.g., the flange fasteners 30, for example, are not visible in an installed position, providing an improved aesthetic or appearance of the deck structure.

The bracket 40 is configured to be operatively attached to a structural member of the deck 102, for example, to a joist 26. As shown in FIG. 1, the bracket 40 may include one or more attachment or mounting portions 50, which may be configured, by way of example, as one or more flanges 50. The attachment portion 50 may define one or more openings 48 each configured to receive a fastener 30 for attachment or mounting of the bracket 40 to the joist 26. The number and configuration of the openings 48 and/or fasteners 30 may vary based on bracket configuration and material, and the material comprising the structure to which the bracket 40 is being attached, etc., to provide sufficient attachment strength to retain the bracket 40 to the attached structure as-installed and as loaded during use.

The fastener 30 may be of any suitable configuration to provide sufficient strength to retain the bracket 40 to the joist 26 during use, e.g., when the railing 100 is in an installed position and subjected to loading during use. By way of non-limiting example, the fastener 30 may be configured as a lag bolt, lag screw, or bolt and nut combination for attachment of the bracket 40 to a structural member 26 comprised of a wood, wood composite, polymer or polymer composite material. As another non-limiting example, the fastener 30 may be configured as a rivet or stud or as a bolt and nut combination for attachment of the bracket 40 to a metallic structural member 26, e.g., a steel or aluminum channel or beam.

The opening 48 may be configured as suitable to receive and provide mounting support for the fastener 30 to connect the bracket 40 to a structural member such as a joist 26. Various configurations of the opening 48 may be provided, including by way of non-limiting example a slot or a generally round, oval, square or rectangular hole. The opening 48 may define a tapered portion, a chamfer, a countersink, a counterbore, or other recessed portion, or other feature to facilitate connection of the bracket 40 to a member 26 using a fastener 30.

The attachment portion 50 may be configured as required for attachment to the deck 102. As shown in FIG. 1, bracket 40A may include a generally planar surface including a plurality of co-planar flanges 50, such that the bracket 40A may be mounted flush against or to the generally vertical surface (in an installed position) of the joist 26. The attachment portions may be configured to be parallel to the vertical mounting surface, e.g., the side surface, of the structural member 26. In another configuration, the bracket 40C may include a plurality of flanges 50 which are substantially perpendicular to each other, such that the bracket 40C can be installed flush to the respective side surfaces of adjacent joists 26 forming a corner of the deck structure 102. The flanges 50 shown in FIG. 1 may extend outward from the sides of the cup portion 52 (in an as-installed orientation). Other orientations and configurations of the attachment portions 50 are possible, for example, a bottom flange (not shown) may be extended downwardly (in an installed position) from the bottom of the cup portion 52, and may be provided in addition to the side flanges 50 or substituted for one of the side flanges 50, for example, for mounting at a non-linear or non-perpendicular section of the deck structure.

Figure 9:
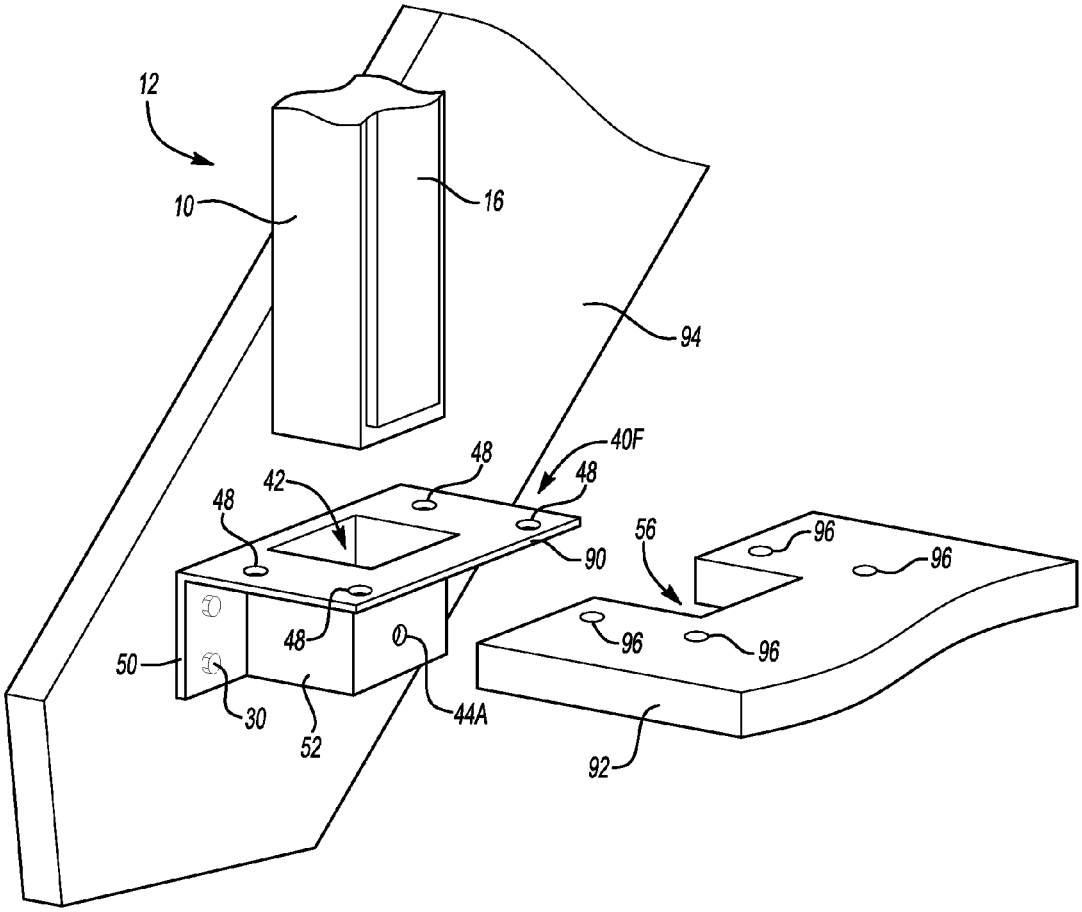
FIG. 9 shows a schematic perspective exploded partial view of a system for interconnecting a stringer of a stairway with a stair railing using a bracket in another configuration.

The attachment portions 50 may be described generally by a flange height FH (see FIG. 2A), a flange width FW (see FIG. 2A) and/or a flange thickness FT (see FIG. 3A), or similar dimensions to describe the size and/or configuration of the attachment portions 50, which may be of other shapes and sizes, and are not limited as shown in FIG. 1 to a generally rectangular shape. Additional attachment portions 50, which may be but are not limited to flanges 50, may be provided for attachment of other members. As shown in FIG. 9, the bracket 40F includes a flange 90 configured for attachment of a stair tread 92. The bracket 40F could also be substituted, for example, for the bracket 40A, such that the flange 90 may be used to operatively attach and/or provide support for the end cap 24.

The cup portion 52 is configured to define an interior perimeter surface 42, which may be generally configured to correspond with the cross-sectional shape of the post 12, such that the post 12 may be inserted into the cup portion 52 with minimal (nominal) clearance between the interior perimeter surface 42 and the exterior perimeter surface of the post 12. As shown in FIGS. 2A-4, the interior perimeter surface 42, which may be referred to herein as a cup 42 or a cup surface, may define a generally rectangular or square cross-section to correspond with the generally rectangular or square cross-section of the post 12 shown in FIG. 1, such that the cup surface 42 generally surrounds the exterior perimeter surface of the post 12 inserted or received therein. The cup 42 defined by the cup portion 52 may be described generally by a cup depth CD (see FIG. 3A), a cup width CW (see FIG. 3A), and a cup height CH (see FIG. 2A) or similar dimensions to describe the size and/or configuration of the cup 42, which may be of other shapes and sizes, and is not limited as shown in FIGS. 1-4 to a generally rectangular shape. As shown in FIG. 5, the cup 42 may define a generally oval or circular cross-section to correspond to a generally oval or round post 12 shown in FIG. 5, and may be described, for example, by a cup diameter and a cup height (not shown).

The cup portion 52 of the bracket 40 may include a base 66 (see FIGS. 3A-3C), which may also be referred to herein as the cup bottom, base support, or base portion. The base 66 may be configured to support the post 12 in an as-installed position such that the post 12 may be held in an upright position when placed in the cup 42 defined by the cup portion 52 of the bracket 40. In this configuration, the post 12 is retained in an upright position by the cup portion 52 without additional attachment to the bracket 40 and/or the deck structure 102.

The base portion 66 may be integral to the cup portion 52, for example, the cup portion 52 may be an extrusion such as a deep drawn extrusion, to which flanges 50 are subsequently attached (see FIG. 3B), such that the base portion 66 is formed during extrusion of the cup portion 52. The bracket 40 may be cast or molded, for example, as a single piece including the cup portion 52 and the base portion 66. The base portion 66 may be operatively attached to the bracket 40 to define the bottom of the cup 42, for example, by one or more of welding, soldering, brazing, riveting, crimping, staking, fastening, etc., and/or using an adhesive to operatively attach the base portion 66 to the bracket 40.

Figure 3A:
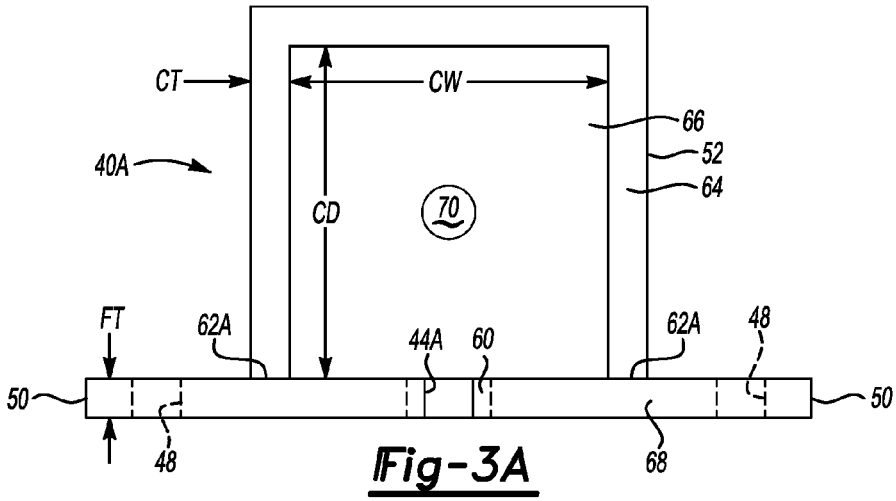
FIG. 3A shows a schematic cross-sectional view of section 3A-3A of FIG. 2A.
Figure 3B:
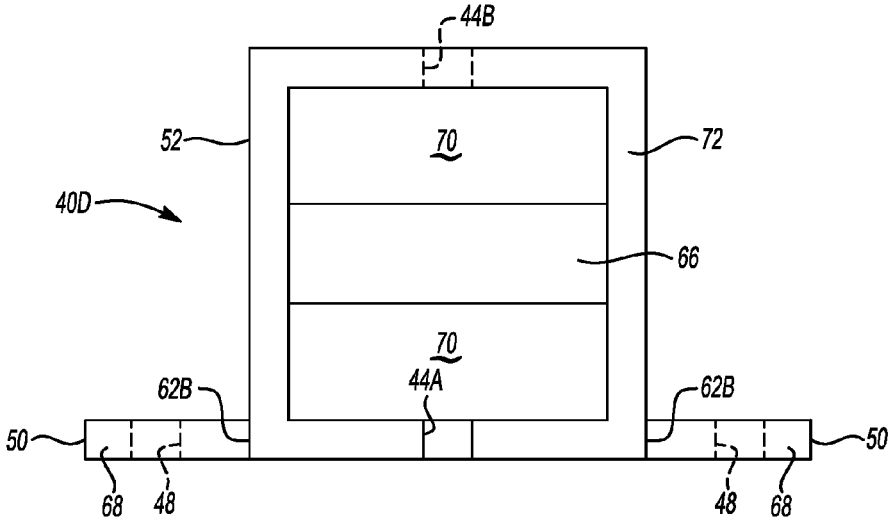
FIG. 3B shows a schematic cross-sectional view of section 3B-3B of FIG. 2B.
Figure 3C:
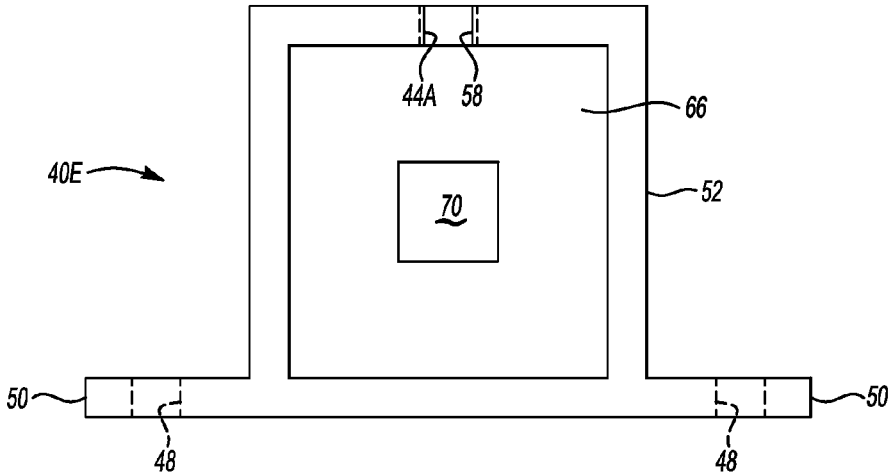
FIG. 3C shows a schematic cross-sectional view of an alternate configuration of a bracket.

Various configurations of the base portion 66 are possible. The base portion 66 may fully enclose the bottom of the cup 42. The base portion 66 may be configured to partially enclose the bottom of the cup 42, e.g., to define at least one opening 70, as shown in FIGS. 3A-3C), wherein the at least one opening 70 is shaped, sized or otherwise configured such that the base portion 66 and cup portion 52 have sufficient strength to support the post 12 in an installed position and during use. By providing at least one opening 70, the weight of the bracket 40 may be reduced, and/or the opening 70 may provide a drain or fluid outlet from the cup 42, and/or provide for fluid flow, including air flow, into and/or out of the cup 42, for example, to facilitate insertion of the post 12 in the cup portion 52 and/or removal of residual moisture from the cup 42 to decrease potential for deterioration of the bracket 40 and/or post 12 due to corrosion, mold, mildew, etc.

In example configurations, and for simplicity of illustration, FIG. 3A shows a round opening 70, FIG. 3B shown two generally rectangular openings 70, and FIG. 3C shows a square opening 70. It would be understood that one or a plurality of openings 70 may be provided, and may be configured in any shape or size. By way of non-limiting example, the base portion 66 may be integral to the cup portion 52, may be configured as woven wire mesh, grating, expanded metal, perforated metal, strip stock, plate, etc. of a suitable material to provide sufficient strength to meet the requirements of the application, and which may be operatively attached to the bracket 40.

The bracket 40 may be fabricated by any suitable method and may be comprised of one or more materials, wherein the materials comprising the bracket may be selected to meet the functional requirements (strength, durability, corrosion resistance, etc.) of the application (structure) incorporating the bracket system, which may vary according to the structure size, loading pattern, intended use, operating environment, etc. By way of non-limiting examples, the bracket 40 may be made from one or more metallic materials, such as steel or aluminum, from a polymeric or a polymeric composite material, of from a combination thereof.

Figure 2A:
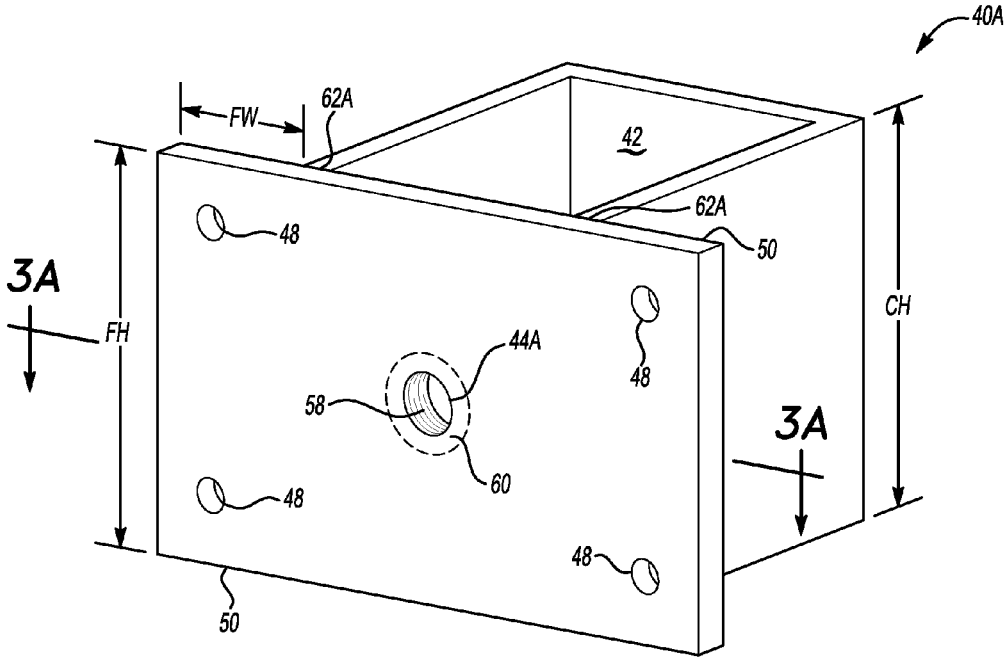
FIG. 2A shows a schematic perspective front view of a bracket of FIG. 1.

The bracket 40 may be formed, as illustrated in FIGS. 2A and 3A and by way of non-limiting example, by attaching the cup portion 52 to the attachment portion 50 at one or more interfaces 62A. The bracket 40A shown in FIGS. 2A and 3A may be formed, for example, by operatively attaching a section of channel or channel stock 64 to a plate 68 at the interfaces 62A. The cross-section of the channel stock 64 may be configured to generally correspond to the shape and size of the post 12, with sufficient clearance allowed such that the post 12 may be installed in the bracket 40A. For example, the channel 64 may be a section of standard sized C-channel with a nominal width and leg length of 4" such that when attached to the plate 68, a cup 42 configured to receive a post 12 including a 4×4 post member 10 is formed. Other channel configurations and sizes may be used to accommodate other post 12 configurations and sizes, which may include, by way of example, a post 12 including one of a 4×6 or 6×6 post member 10, as previously described, or a generally round or oval post as shown in FIG. 5. Other configurations of channel, including but not limited to U-channel and C-channel, or similar structural members, such as sections of open seam tube, may be used. In the present example, the channel stock 64 and plate 68 may be made of a metallic material and operatively attached by welding and/or brazing. The base portion 66 may be provided as described previously.

Figure 2B:
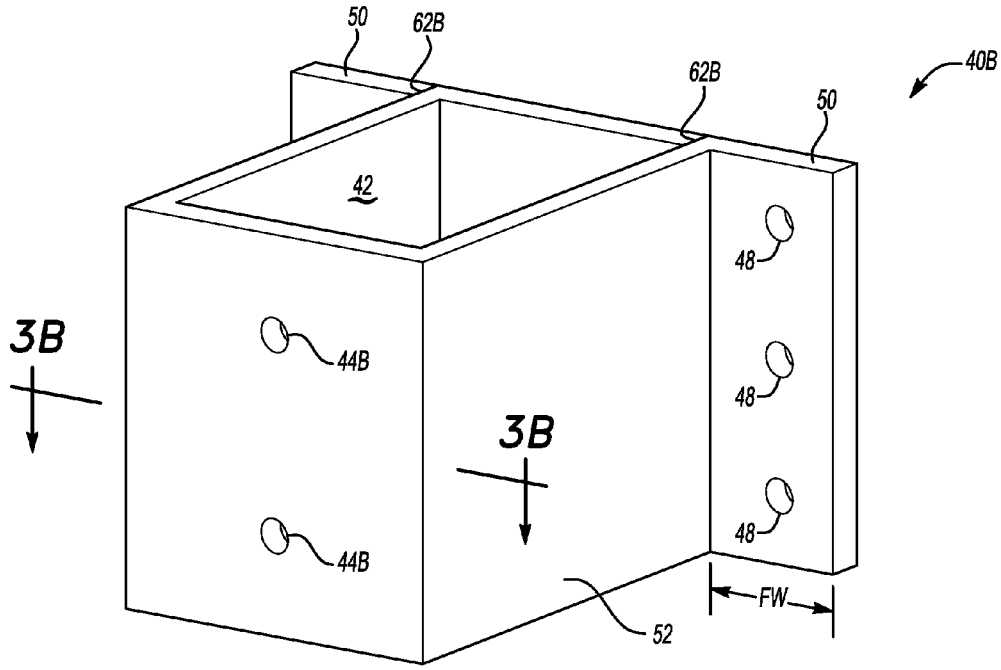
FIG. 2B shows a schematic perspective rear view of an alternate configuration of a bracket of FIG. 1.

The bracket 40 may be formed, as illustrated in FIGS. 2B and 3B and by way of non-limiting example, by attaching the cup portion 52 to the attachment portion 50 at one or more interfaces 62B. The bracket 40D shown in FIG. 3B may be formed by operatively attaching a section of tubing or tube stock 72 to a plurality of plates 68 at the interfaces 62B. The cross-section of the internal opening of the tube stock 72 may be configured to generally correspond to the shape and size of the post 12, with sufficient clearance allowed such that the post 12 may be installed in the bracket 40D. For example, the tubing 72 may be a section of standard sized tubing with a nominal size of 4"×4" and wall thickness of ⅛" with an interior surface defining a cup 42 configured to receive a post 12 including a 4×4 post member 10. Other tubing configurations and sizes may be used to accommodate other post 12 configurations and sizes, which may include, by way of example, a post 12 including one of a 4×6 or 6×6 post member 10, as previously described. In the present example, the tube stock 72 and the plates 68 may be made of a metallic material and operatively attached by welding and/or brazing. The base portion 66 may be provided as described previously.

The bracket 40 may be formed, as illustrated in FIG. 3C and by way of non-limiting example, as an integral unit, such that the cup portion 52 and the attachment portions 50 are formed concurrently. For example, the bracket 40D shown in FIG. 3C may be formed, for example, by casting or molding. The base portion 66 may be casted or molded during the forming of the cup and attachment portions 52, 50, or may be provided as described previously. The bracket 40D may include one or more reinforcement members (not shown), which may be metallic reinforcement members, which are over molded with a polymer to form the bracket 40D.

Figure 4:
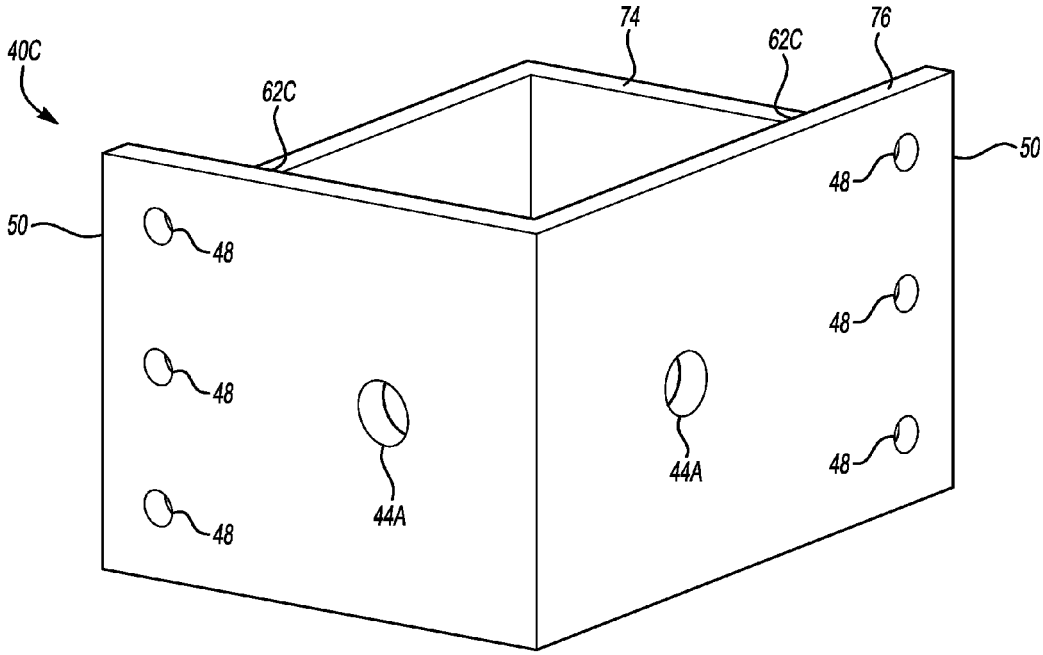
FIG. 4 shows a schematic perspective front view of an alternate configuration of a bracket.
Figure 5:
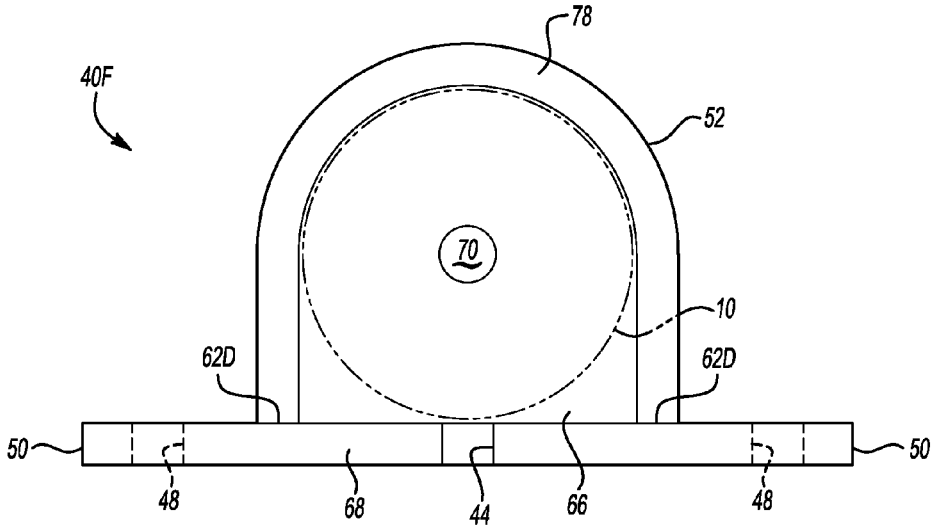
FIG. 5 shows a schematic perspective top view of an alternate configuration of a bracket.

The bracket 40 may be formed, as illustrated in FIG. 4 and by way of non-limiting example, by operatively attaching a section of angle (angle stock) 74 to another section of angle (angle stock) 76 at the interfaces 62C. The respective cross-sections of the angle sections 74, 76 may be configured such that when attached to form the bracket 40C, a cup 42 is defined which generally correspond to the shape and size of the post 12, with sufficient clearance allowed such that the post 12 may be installed in the bracket 40C. In the example shown, the length of each of the legs of the angle section 76 may be longer than the length of each of the legs of the angle section 74 such that the ends of the legs of the angle section 76 extend beyond the interfaces 62C to form the flange portions 50. For example, the angle 74 may be a section of standard sized equal leg angle with a nominal leg length of 4 inches, and angle 76 may be a section of standard sized equal leg angle with a nominal leg length of 6 inches, such that when attached each other to form the bracket 40C as shown in FIG. 4, a cup 42 configured to receive a post 12 including a 4×4 post member 10 is provided. Other angle configurations and sizes may be used to accommodate other post 12 configurations and sizes, which may include, by way of example, a post 12 including one of a 6×6 or 4×6 post member 10, as previously described. In the latter example, a cup portion 42 configured to receive a post including a 4×6 post member 10 may be formed by attached a section of L-angle 74 with unequal leg sections measuring 4" and 6" to a section of L-angle 76 with unequal leg sections measuring 6" and 8". Other configurations of angle or channel, including but not limited to equal leg angle, unequal leg angle or angle with non-perpendicular legs, e.g., defining an included angle other than 90 degrees, may be used. In the present example, the angle stock 74, 76 may be made of a metallic material and operatively attached by welding and/or brazing. The base portion 66 may be provided as described previously.

The bracket 40 including the flange portions 50 and the cup 42 may be configured in various sizes and shapes, which may be determined by or proportional to the members interfacing with the bracket 40, e.g., the post 12 and the structural members such as the joist 26 of the deck 102, such that the bracket size and shape is sufficient to support and/or transmit the load imposed on the bracket 40 and/or the post 12 during use. The bracket 40 may be configured in a size such that the bracket 40 is not generally visible from the exterior or outwardly facing surfaces of the deck structure 102, e.g., such that the bracket 40 does not protrude beyond the surface of the structural member(s) 26 to which the bracket 40 is operatively attached. For example, the joists 26 may be made of lumber of a standard size designation, such as a 2×8, wherein the designation relates to the size in inches of the generally rectangular cross-section of the board before finishing, which may correspond to a finished (dried/cured and planed) generally rectangular cross-section nominally measuring 1½"×7¼." In this instant example, the bracket 40 may have, for example, a flange height FH and/or cup height CH measuring no greater than 7 inches. It would be understood that the flange height FH and the cup height CH may be different, e.g., the cup height CH may be greater than, less than or equal to (within manufacturing tolerances) the flange height FH. For configurations including more than one flange 50, it would be understood that the flanges 50 may be different shapes and/or sizes.

As shown in FIG. 1, various methods and configurations may be used to adjust the position of the post 12 in the cup 42, and/or retain the post 12 in the bracket 40. The position of the post 12 may be adjusted, for example, to eliminate all or substantially all of the clearance between a surface of the post 12 in proximate contact with an interior surface of the cup portion 52, and such that the post 12 in an as-installed configuration is held with sufficient pressure against the interior surface of the cup portion 52 so that the post 12 may be retained in the bracket 40 with sufficient pressure to resist or prevent removal of the post 12 from the cup 42. The post 12 may be retained in the bracket 40 by an adjustable member which is positioned to interfere with an interfacing portion 18 of the post 12, which may be a portion, feature or element of the post 12, such as, by way of non-limiting example, a portion of the post member 10, a surface of the face plate 16, and/or a feature defined by the face plate 16, such as a slot 80 or a recess 82 (see FIG. 7A).

Referring to bracket 40A and post 12A shown in FIG. 1, in a non-limiting example, an adjustable retention feature may be configured to include an opening 44A provided in the bracket 40A and an adjustable member 28. The adjustable retention feature may include one or more washers 36 which may be used to facilitate maintaining the adjustable member 28 in a desired position and/or at a desired torque, and/or which may be used to adjust for variation in the adjustable member 28 and/or the elements proximate to the adjustable member 28, including, for example, one or more of the joist 26, the bracket 40, the post 12 including the post member 10 and/or face plate 16, or other elements not shown in FIG. 1, for example, a fascia 86 (see FIG. 6C), etc., where the variation may include variation in dimension, material properties or other characteristics or properties of each element.

Figure 6A:
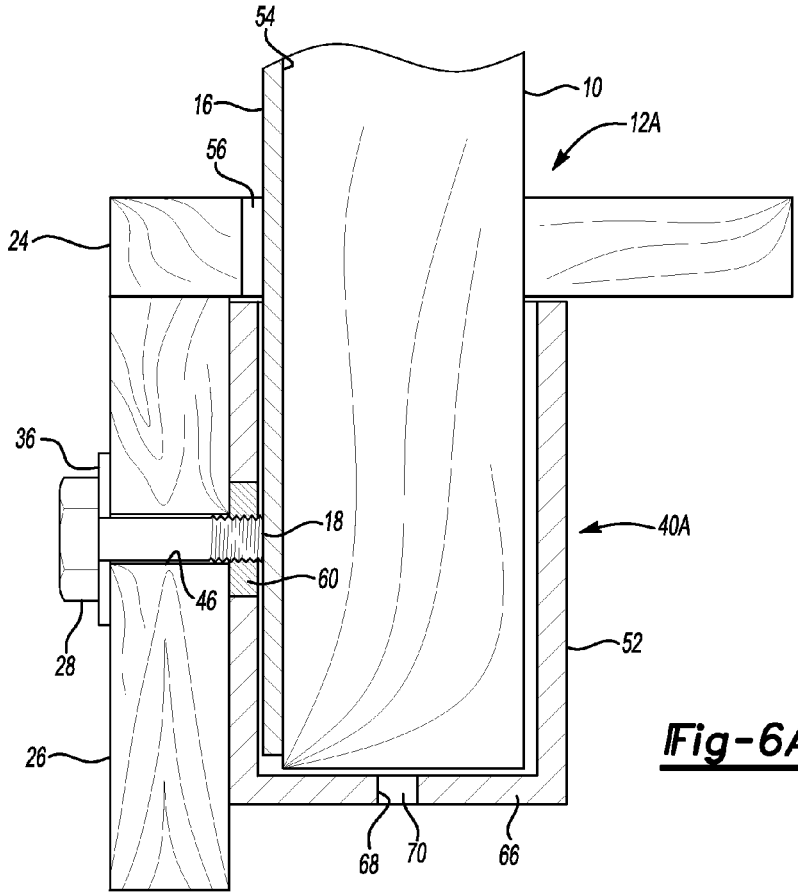
FIG. 6A shows a schematic cross-sectional view of section 6-6 of FIG. 1 showing the bracket of FIG. 2A.

The opening 44A, which may be referred to as a bracket opening, may be provided in the cup portion 52 such that the opening 44A is oriented toward the structural element 26 to which the bracket 40 is operatively attached, as shown for example, for bracket 40A in FIGS. 1, 2A and 3A, and for bracket 40C shown in FIGS. 1 and 4. An opening 46, which may be referred to as a joist opening or through hole, may be provided in the joist 26, and configured to receive the adjustable member 28 such that the adjustable member 28 may be operatively attached to the opening 44A. The through hole or opening 46 may be formed in the joist 26 by any method suitable for the material comprising the joist 26. For example, the joist 26 may be a wood member and the opening 46 may be formed by drilling a through hole through the thickness of the joist 26, and positioned such that when the bracket 40 is operatively attached to the joist 26, the through hole 46 is aligned with the opening 44A in the bracket 40. The adjustable member may be configured as a lag bolt 28, and the through hole 46 in the joist 26 may be shaped or sized with sufficient clearance to receive the body (shank and threads) but not the head of the lag bolt 28. The bolt 28 may be configured with a flanged head bolt, as shown in FIG. 6C. One or more washers 36 may be placed between the head of the lag bolt 28 and the joist 26 in an as-installed position, to retain the head of the bolt in proximate contact with the surface of the joist 26, and/or to adjust for variation in the thickness of the joist 26, the position of the opening 44A, and/or the length of the lag bolt 28 to ensure proper engagement of the lag bolt 28 with the bracket 40 and/or post 12.

The opening 44A may be a threaded opening, as shown in FIG. 2A, such that the lag bolt 28 may be engaged with or operatively attached to the bracket 40 by engaging the threads of the lag bolt 28 with the threads 58 (see FIG. 2A) defined by the opening 44A. The threads 58 in the opening 44A may be formed, for example, by cutting, tapping, and/or roll forming the thread form into a hole formed in the cup portion 52 of the bracket 40. The threaded opening 44A may be provided, by way of the non-limiting example shown in FIGS. 2A and 3A, by configuring the bracket 40 to include an insert 60, which may be, in a non-limiting example, a nut, washer or other insert which is operatively inserted in, attached to and/or retained by the cup portion 52 by, for example, welding, brazing, press fitting, staking, crimping, use of an adhesive, and/or a combination of these. The insert 60 may define the opening 44A, which in the instant example is threaded and configured to be operatively engaged with the threads of the lag bolt 28. The insert 60 may include the opening 44A, which may or may not be may be threaded, prior to operatively attaching the insert 60 to the cup portion 52. In the latter case, the opening 44A may be threaded after being operatively attached to the cup portion 52, as described previously, by tapping, cutting and/or rolling the threads 58. The insert 60 may be operatively attached to the cup portion 52 such that the opening 44A is formed in the insert 60 after attachment to the cup portion 52, for example, such that the opening 44A and/or threads defined thereby may not be subject to thermal and/or mechanical distortion during installation of the insert 60.

The opening 44A may be configured as a through hole or opening, e.g., the opening 44A may be sized and shaped to receive the adjustable member 28 without operatively engaging with the adjustable member 28. The opening 44A may not be threaded, and may be of any shape, size of configuration to provide clearance for the adjustable member 28 to make operative contact with the post 12. In a non-limiting example shown in FIG. 6C, the adjustable member 28 may be configured as a lag screw, and the post 12 comprises the post member 10, such that the lag screw 28 may be operatively attached to the post member 10 and sufficiently tightened (torque) to substantially eliminate the clearance between the post 12 and the cup portion 52, and/or to retain the post 12 in the bracket 40. The adjustable member 28 may be configured with a flanged head 30 defining an increased surface or interface area contacting the surface of a structural member of the deck 102, which as shown in FIG. 6C may be a fascia member 86. The flanged head bolt 28 shown in FIG. 6C may include a serrated surface interfacing with the structural member 86, to improve torque retention in the as-installed position.

As shown in FIG. 1, a portion of the adjustable member 28, e.g., the bolt head, and the washer 36 (where included) may be visible in the installed position when viewing the outwardly facing surface of the deck structure 102. A cap 34 may be provided to cover the visible portion of the bolt 28 and/or washer 36, to improve the finished appearance of the deck 102, and/or to protect the adjustable member 28 from deterioration and/or damage which may detrimentally affect the ability to adjust and/or remove the adjustable member 28. For example, the cap 34 may prevent or minimize exposure to environmental elements, thus minimizing corrosive damage to the adjustable member 28 and/or the washer 36. The cap 34 may be configured as a decorative element, e.g., may be formed to define a decorative shape and/or pattern (not shown), and may be finished accordingly. The cap 34 may be configured from any suitable material, which may be polymeric or metallic material or a combination of these, and may include a retention feature (not shown) such as a clip, spring, or press-fit feature for operatively attaching the cap 34 such that the cap 34 covers the bolt 28.

Other methods and configurations may be used to adjust the position of the post 12 in the cup 42, and/or retain the post 12 in the bracket 40. The post 12 may be positioned and/or retained in the bracket 40 by at least one adjustable member 32 which may be introduced through an opening 44B in the bracket 40C (see FIG. 1) and attached to a portion of the post member 10. The adjustable member 32 may, by way of non-limiting example, be configured as a wood screw. The wood screw 32 may be fastened (tightened) to substantially eliminate any clearance between the interfacing surfaces of the post member 12 and the cup 42. The bracket 40B may include more than one opening 44B, and more than one wood screw 32 may be used to operatively attach the post 12 to the bracket 40.

The bracket system including at least one adjustable member 32 and at least one opening 44B may be used, for example, where use of an adjustable member 28 and opening 44A may not be feasible or desirable, for example, when the surface portion of the member 26 where the access opening 46 must be located to access the bracket hole 44A is not readily accessible, or where it is preferred and/or required that the adjustable member 28 not be visible from a viewable surface of the structure 102. The bracket 40 may be configured to include at least one opening 44B and an opening 44A, for example, as shown for bracket 40C in FIGS. 1 and 8, to provide the option of using either or more retention methods during construction of the structure 102, or, for example, where permanent installation of the railing 100 may be desired, while retaining the ability to adjust the position of the post 12 in the cup 42 over time, as the deck 102 and railing 100 components age, wear, distort, warp, etc., so as to maintain the railing 100 in a tightened and stable condition with respect to the deck 102.

FIGS. 2A-5 show various non-limiting example configurations of a bracket 40 which may be used with the bracket system described herein. In a first example configuration shown in FIG. 2A is a schematic perspective front view of a bracket 40A. The bracket 40A includes an attachment portion 50 which as configured for bracket 40A includes two coplanar flanges 50. Each flange 50 defines at least one opening 48 configured, as described previously, for receiving a fastener 30 to connect the bracket 40A to a structural member 26, as previously described for FIG. 1. The bracket 40A further includes an opening 44A configured, as described previously, for receiving an adjustable member 28. In the example shown in FIG. 2A, the opening 44A is defined by threads 58, wherein the threads 58 are configured to operatively engage with the threads of an adjustable member 28. The opening 44A may be formed in the cup portion 52, or the bracket 40A may include an insert 60 which may define the opening 44A and/or the threads 58. The bracket defines a cup 42 configured to receive the post 12.

In another non-limiting example configuration, the FIG. 2B shows a schematic perspective rear view of the bracket 40B including a cup portion 52 defining at least one opening 44B. The opening 44B may be configured, as described previously, for receiving an adjustable member 32. As described previously, the attachment portion 50 may include a plurality of openings 48, which may vary according to the requirements of the structure including the bracket 40. The bracket 40B may further include, for example, an opening 44A to receive an adjustable member 28, such that a post 12 may be retained in the cup 42 by an adjustable member received through either opening 44A, 44B, or both, as is shown for bracket 40C in FIGS. 1 and 8.

FIGS. 3A-3C shows a schematic cross-sectional view of the bracket 40, in various non-limiting configurations. As described previously, the cup portion 52 of the bracket 40 may include a base 66. The base 66 may be configured to support the post 12 in an as-installed position such that the post 12 may be held in an upright position in the cup portion 52. The base 66 may be of various configurations, as described previously related to FIG. 1, and may define an opening 70, for example, to provide a drain or fluid outlet from the cup portion 52, and/or to provide for air circulation to the end of the post 12 inserted in the cup portion 52.

In a first non-limiting example shown in FIG. 3A, the bracket 40D includes a base portion 66 defining a generally round or oval opening 70. In another non-limiting example shown in FIG. 3B, the bracket 40 includes a base portion 66 configured as a member operatively attached to and extending from one side or perimeter section of the cup 42 to another side or perimeter section of the cup 42, such that the base member 66 and the cup portion 52 define at least one opening 70. The base portion 66 may be configured as a generally rectangular member, or may be of another shape or configuration. In another non-limiting example shown in FIG. 3C, the bracket 40D includes a base portion 66 defining a generally square or rectangular opening 70.

Figure 8:
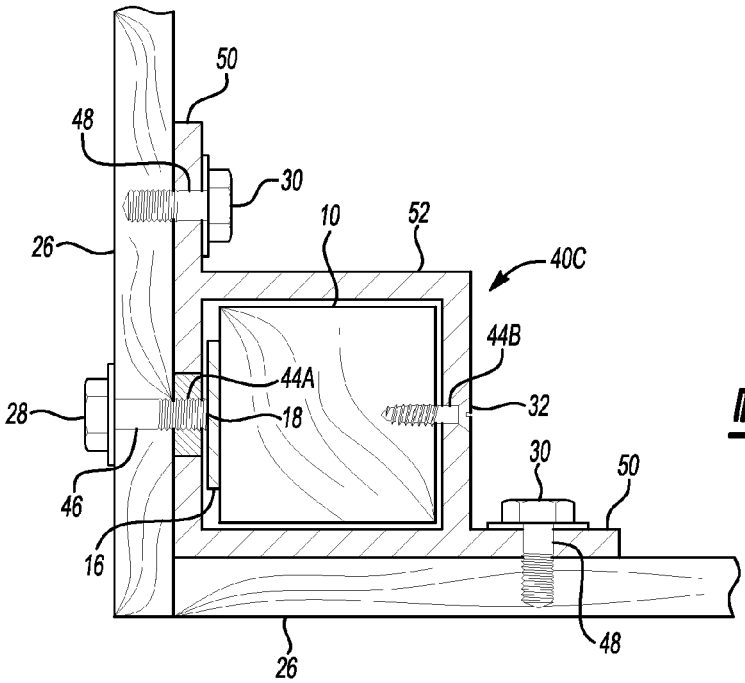
FIG. 8 shows a schematic cross-sectional view of section 8-8 of FIG. 1 showing the bracket of FIG. 4.

FIG. 4 shows a non-limiting example of a bracket 40 configured for use as a corner bracket 40C, e.g., configured to be attachable to two abutting or adjacent structural members 26 as shown in FIG. 1, such that the bracket 40C in an installed position may operatively attach the abutting or adjacent structural members 26 to each other. The bracket 40C may include an opening 44A to receive an adjustable member, such that a post 12 may be retained in the cup portion 52 by an adjustable member 28 received through the opening 44A. More than one opening 44A may be provided, for example, such that either or both of the openings 44A may be used to adjust and/or retain the post 12 in the cup portion 52, or such that at least one of the openings 44A may be accessible from an exterior surface of the structure 102 for installation of the adjustable member 28. As shown in FIG. 8, the bracket 40C may further include one or more openings 44B to receive an adjustable member 32, such that a post 12 may be retained in the cup portion 52 by an adjustable member received through either of the openings 44A, 44B, or a combination thereof. The post 12 may be retained by a combination of members 28, 32 to provide additional reinforcement, stabilization or retention strength, as may be desirable for a corner post 12 retained in the corner bracket 40C, to accommodate higher loads which may be experienced by a corner post 12.

FIG. 5 shows another example configuration of a bracket 40F. The bracket 40F may include a plate 68 configured substantially similar to plate 68 in FIG. 3A, including a cup portion 52 configured to correspond at least partially with the shape of the post 12, such that the post 12 may be inserted into and retained in the cup portion 52 with minimal (nominal) clearance using an adjustable member 28 received through an opening 44, as previously described. The bracket 40F may be formed using any suitable means including but not limited to welding, brazing, casting, molding, etc. By way of non-limiting example, the cup portion 52 may be operatively attached to the attachment portion 50 at one or more interfaces 62D, wherein the cup portion 52 may be a section of channel, angle or tube 78, and a base portion 66 provided as previously described.

A method is provided for installing a removable object 100 including at least one removable member 12 to a structure 102 including at least one bracket 40 using the bracket system described herein. In a non-limiting example, the removable object 100 may be configured as a railing section or railing 100, as shown in FIG. 1, for installation to a deck structure 102. Referring now to FIG. 6A and FIG. 1, in a non-limiting example the method includes operatively attaching a bracket such as the bracket 40A to a structural member of the structure 102, such as a joist 26. The bracket 40A may be operatively attached to a generally vertical surface (in an as-installed position) of the joist 46 using one or more fasteners 30, which may be inserted through one or more openings 48 in an attachment portion 50 of the bracket 40A and operatively fastened or attached to the joist 26. The bracket 40A may be positioned on the joist 26 such that an opening 44A (see FIG. 1) in the bracket 40A is generally aligned with an opening 46 in the joist 26, such that a fastener 28 may be received in, e.g., inserted through the opening 46 to be engageable with the opening 44A. The opening 46 in the joist 26 may be formed or provided prior to or after attaching the bracket 40A to the joist 26.

The method continues by inserting a removable member 12, such as the post 12A, into a cup portion 52 of the bracket 40A, wherein the cup portion 52 is configured to retain the post 12A in a supported or oriented position, which in the present example is a generally upright (vertical) position, which may also be perpendicular and/or parallel to the joist 26. The cup portion 52 may include a base portion 66 configured to support the post 12A in the oriented position. The cup portion 52 may define an interior perimeter surface 42 having sufficient clearance to receive the post 12, e.g., such that the post 12 may be inserted into the cup portion 52, and of sufficient depth to retain the post 12 in the oriented position, e.g., in an upright or generally vertical position in the present example. The cross-sectional shape or area of the interior perimeter surface of cup 42 may be generally configured to correspond with the shape of the post 12, such that in an installed position minimal (nominal) clearance is provided between the interior perimeter surface 42 of the cup portion 52 and the exterior perimeter surface of the post 12.

The post 12A may include a post member 10 and a face plate 16, as described previously. The post 12A may be inserted into the bracket 40A such that an interface surface 18 of the face plate 16 is proximate to the opening 44A (see FIG. 1) in the bracket 40. An adjustable member 28, which in the example shown in FIG. 6A may be a locking bolt 28, is inserted into the opening 46 in the joist 26, and engaged with the opening 44A defined in the bracket 40. In the present example, the bolt 28 is threaded into the threads 58 (see FIG. 2A) to engage the bolt 28 with the opening 44A. The bolt 28 is adjusted (threaded, tightened, torqued) such that the bolt 28 is positioned in contact with the face plate 16 of the post 12. The bolt 28 may be adjusted to minimize clearance between the post 12 and the surface of the cup 42, to stabilize, position, align and/or retain the post 12 in the bracket 40, by creating an interference fit with the interface surface 18 of face plate 16. A frictional force between the bolt 28 and face plate 16 may be created by the interference fit which may be sufficient to resist vertical movement of the post 12.

One or more washers 36 may be included to facilitate tightening the bolt 28 to a desired torque or interference fit with the post 12, and/or to adjust for variation in the length of bolt 28, the thickness of joist 26, the size of post 12, etc. The post 12 is easily removable from the bracket 40, e.g., readily disassembled from the deck 102 for seasonal storage, maintenance, etc., by subsequently loosening (disengaging) the bolt 28 sufficiently to reduce or eliminate the contact or interference between the bolt 28 and the interface surface 18 of the face plate 16 so that the post 12 can be removed from the cup 42.

Figure 6B:
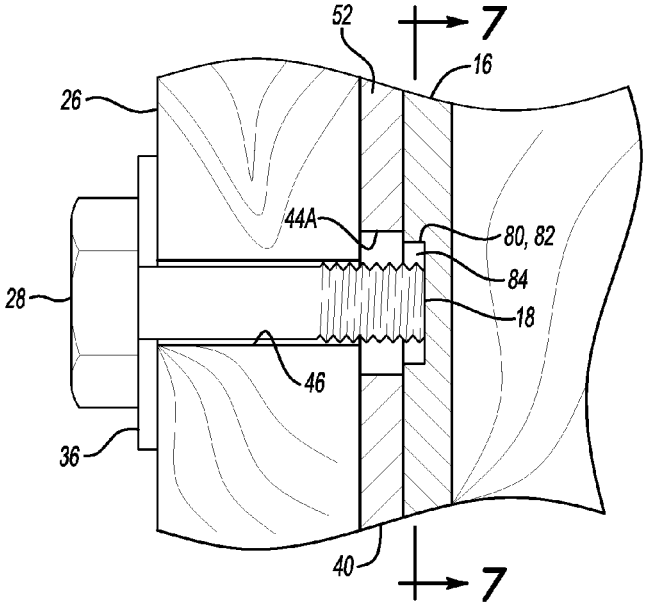
FIG. 6B shows a schematic cross-sectional view of section 6-6 of FIG. 1 showing an alternative configuration of a bracket and a face plate.
Figure 7A:
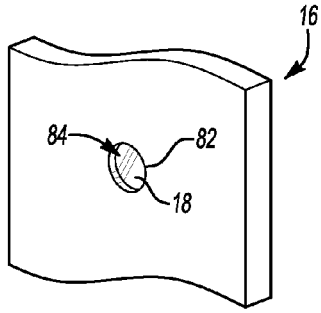
FIG. 7A shows a schematic cross-sectional view of section 7-7 of FIG. 6B showing an alternative face plate configuration.
Figure 7B:
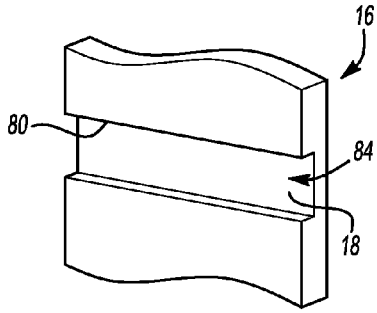
FIG. 7B shows a schematic cross-sectional view of section 7-7 of FIG. 6B showing another alternative face plate configuration.
Figure 6C:
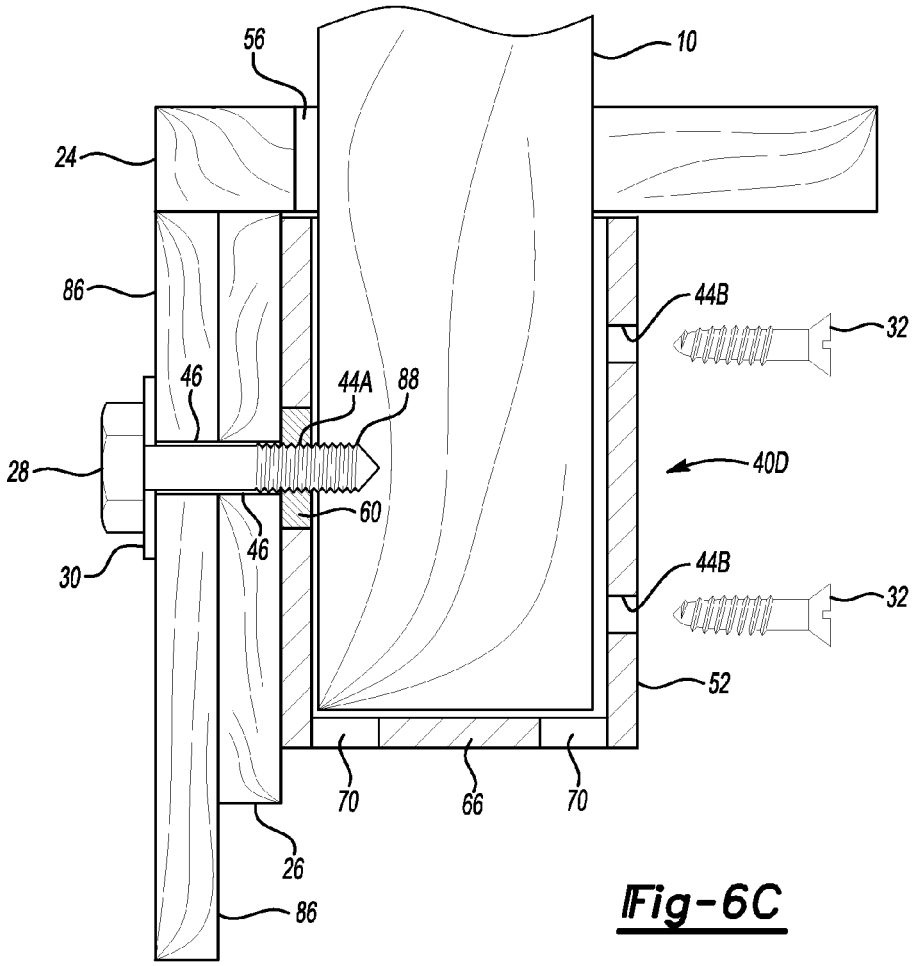
FIG. 6C shows a schematic cross-sectional view of section 6-6 of FIG. 1 showing an another alternative configuration of a bracket and a post.

In a non-limiting example, FIGS. 6B, 7A and 7B show alternative configurations for the interface surface 18 of the face plate 16. A recess 84 is defined by the face plate 16, such that the end of the bolt 28 is positioned in the recess 84 when in operative contact with or proximate to the interface surface 18. The recess 84 may be of any suitable configuration to resist removal of the post 12 from the bracket 40 by providing a surface which interferes with the bolt 28 when the post 12 is moved in a vertical direction. In a first non-limiting example, the recess 84 is defined by a hole 82 as shown in FIG. 7A, wherein the radial surface of the hole 82 is configured to interfere with the end of the bolt 28, when the bolt 28 is in the as-installed position as shown in FIG. 6B and the post 12 is moved in a vertical direction. In a second non-limiting example, the recess 84 is defined by a slot 80 as shown in FIG. 7B, wherein the generally horizontal surface of the slot 80 is configured to interfere with the end of the bolt 28, when the bolt 28 is in the as-installed position as shown in FIG. 6B and the post 12 is moved in a vertical direction.

In another non-limiting example, FIG. 6C shows the post 12C comprising a post member 10 and a bracket 40D. Any side of the post member 10 may be used to provide an interfacing side 54 and an interface surface 18, such that the post member 10 may be inserted into the bracket 40D without a need to orient the post 12C with respect to the opening 44A. An adjustable member 28, which in the example shown in FIG. 6C may be a lag bolt, is inserted into the opening 46 in the joist 26, and engaged with the opening 44A defined in the bracket 40D. The bolt 28 may be received by the opening 44A and engaged with a hole 88 in the post member 10. The opening 44A may be configured as a through hole 44A such that the bolt 28 may be inserted through the opening 44A. The through hole 44A may be of any suitable configuration including but not limited to a generally oval or rectangular opening or slot. The opening 44A may be threaded as shown in FIG. 2A to engage with the threads of the bolt 28. The hole 88 may be formed by any suitable means including drilling a hole of suitable size in the post member 10 before or after insertion of the post member 10 in the bracket 40 such that the threads of the bolt 28 can engage with the surface of the hole 88 to retain the bolt 28 in the post member 10, thereby retaining the post 12C in the bracket 40D. The bolt 28 may be adjusted to minimize clearance between the post 12 and the surface of the cup 42, and/or to stabilize, position, align and/or retain the post 12 in the bracket 40.

The bolt 28 may be configured with a flange portion 30 to facilitate tightening the bolt 28 to a desired torque. One or more washers (not shown) may be included to adjust for variation in the engaged components, as described previously. The post 12 is removable from the bracket 40, e.g., may be disassembled from the deck 102 for seasonal storage, maintenance, etc., by subsequently disengaging the bolt 28 from the post member 10. The configuration shown in FIG. 6C may be preferred, for example, where permanent or semi-permanent installation of the removable structure 100 is considered and the other advantages of the bracket system are desired, including but not limited to adjustability of the fastener 28 to compensate for changes in the post member 10, railing 102 and structure 100 as these age, shrink, warp, etc. to maintain alignment and stability of the post member 10 in the bracket 40, the support provided by the base 66 and cup portion 52, etc.

FIG. 6C shows another optional construction of the bracket 40D including one or more openings 44B defined by an inwardly facing side of the cup portion 52. In an optional configuration, one or more fasteners 32, which may be configured, for example, as wood screws, may be used to engage the post member 10 in the bracket 40. The fasteners 32 may be used in conjunction with the fastener 30 to retain the post 12 in a bracket, such as bracket 40C shown in FIG. 8. The fasteners 32 may be used instead of the fastener 30 to retain the post member 10 in the bracket 40, as shown for the post 12C in FIG. 1.

The fasteners 28, 32 may be used to retain a post 12 including a face plate 16, such as a post 12A, where additional column strength is desired in post 12. In this instance, the post 12A may be oriented in the bracket 40 such that the face plate 16 is oriented proximate to a surface of the cup portion 52 which does not define an opening 44A or 44B which is to receive a fastener 28 or 32, such that the face plate 16 does not interfere with installation of the fastener into a hole 88 defined by the post member 10.

The bracket 40 may be configured with openings 44A and 44B, as shown in for bracket 40D in FIG. 3B, to provide installation options during assembly. For example, the post member 10 may be retained using fasteners 32 installed in openings 44B where the exterior surface of the deck 102 is not readily accessible to form an opening 46 and/or install a fastener 28, or where it is preferred that the fasteners not be visible from an outwardly facing surface (visible from the exterior of deck 102).

FIG. 8 shows another non-limiting configuration of a bracket 40 including flange portions 50 which are generally perpendicular with respect to each other, such that the bracket 40 may be operatively attached to generally perpendicular structural members 26. The bracket 40 may be configured, by way of example, as shown in FIG. 8 or as previously described for FIG. 4, to provide installation options in the construction of a structure 102. The post 12 may be installed in the bracket 40 by any of a variety of methods described herein, using one or more of the fasteners 28, 32 and openings 44A, 44B, depending on the configuration of the bracket 40 and adjacent structural members 26.

Other configurations and uses of the bracket system described herein are possible. In another example, FIG. 9 shows a bracket system for interconnecting a post 12 to a stairway including a structural member 94. As shown in FIG. 9, the structural member 94 may be configured as a stringer, to which one or more stairs, e.g., treads 92, may be attached. The post 12 may be configured as a railing post 12 comprising a stair rail (banister, hand rail) for the set of stairs (stairway) including the stringer 94 and stairs formed from treads 92, which may be included in a deck comprising a deck structure 102 and a railing 100. As described previously for the deck structure 102 and the railing 100, the stringer 94 and the stair tread 92 may be made of any material suitable to the structure incorporating the stairway including these members. By way of example, the stringer 94 and/or the tread 92 may be made of wood, which may be pressurized or pretreated wood, wood composites, plastic, polymeric or polymeric composite materials, aluminum, steel, other metals or structural materials, etc. The stringer 94 and/or the tread 92 may be painted, stained, coated, plated, galvanized, oxidized, black oxided, etc. or otherwise treated, for example, to increase resistance to weathering, aging, corrosion and/or deterioration due to environmental factors, and/or for decorative or appearance purposes.

The bracket 40 supporting the rail 12 may be configured as previously described, for example, as the bracket 40A, 40B, etc. and operatively attached to the stringer 94 or other structural member of the deck 102 to support the post 12 or a stair rail including a post 12. In the non-limiting example shown in FIG. 9, the bracket may be configured as a bracket 40F including an attachment portion 90 defining one or more attachment features 48. In the example shown, the attachment portion 90 may be configured as a generally horizontal flange 90, and the attachment feature 48 may be configured as an opening to receive a fastener to operatively attach the bracket 40F and the stair tread 92. The opening 48 may be of any suitable configuration, e.g., a generally oval or rectangular opening, slot, etc. The stair tread 92 may be configured with a notched portion or slot 56 to provide an opening through which the post 12 may be received into the bracket 40F.

In a first example, the stair tread 92 may be operatively attached to the bracket 40F using wood screws or other suitable fasteners received through the openings 48 and operatively fastened into the tread 92. In a second example, the stair tread 92 may include one or more openings 96, which may be configured as through holes. The tread 92 may be operatively attached to the bracket 40F using, for example, a bolt inserted through the hole 96 and opening 48 and fastener with a nut. Other variations are possible. As described previously, the bracket may be configured as a bracket 40A or 40B, and the tread 92 may be operatively attached to the stringer 94 (not shown). A stair rail comprising the post and bracket system shown in FIG. 9 would provide a number of advantages. The post 12, reinforced by a face plate 16 may provide a railing of increased strength and/or resistance to shear loads. The stair railing including the post 12 may be removable, for example, for maintenance or to facilitate moving objects wider than the access provided between the stair railings onto and off of the deck 102.

Other configurations and uses of the bracket system as described herein are possible. For example, one or more bracket 40 may be attached to joists or other structural members 26 within the deck structure 102 to support posts 12 comprising, by way of non-limiting examples, a bench or other form of seating, a table, a countertop, a storage box, a planter box, a screen, a wall or other member as may be provided to the deck structure. Advantages of these types of configurations may include the capability to provide support and stability to the member (seating, box, wall, etc.) including the post 12, and to provide an adjustable and removable mounting system such that the member may be removable for seasonal storage, maintenance, or ease of replacement in the event of damage, etc.

Figure 10:
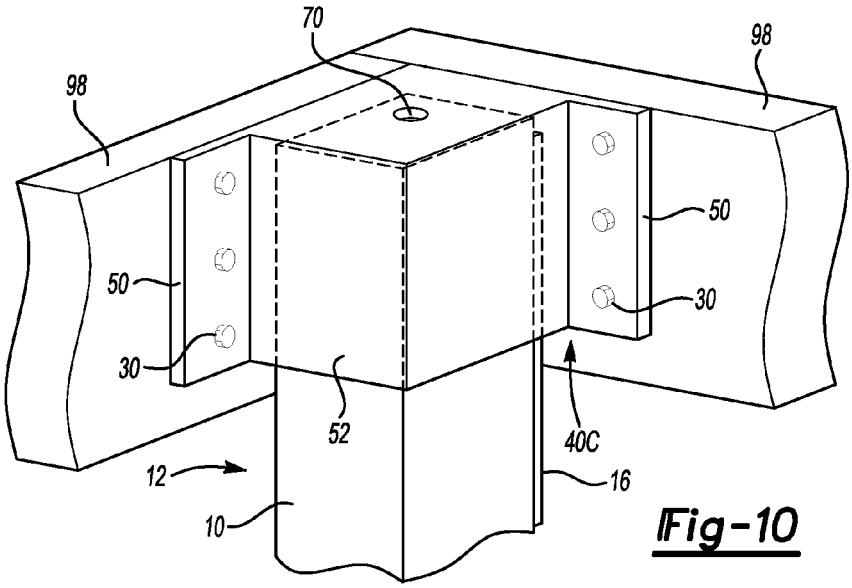
FIG. 10 shows a schematic perspective partial view of a system for interconnecting a top railing and a rail post using the bracket of FIG. 4.

The bracket system may be used in configurations other than to support a post 12 in a generally vertical or upright orientation. For example, FIG. 10 shows a schematic view of a bracket 40C operatively attached to members 98. A post 12 is inserted in the cup portion 52 of the bracket 40C, such that the post 12 (which may be supported at the other end (not shown) by another bracket 40 or other means) and the bracket 40 are supporting the members 98. By way of non-limiting example, the post 12 may be a railing post 12 and the members 98 may be top rails comprising a railing 100 (see FIG. 1). The post 12 may be inserted in the cup portion 52 such that the bracket 40 and the attached rails 98 are supported without the need to further attach the post 12 and the bracket 40. Configured as such, the top rail portion including the rails 98 and the bracket 40 may be readily removable from the post 12, for example, for seasonal storage or disassembly of the railing 100. The bracket 40 may include one or more openings 44A, 44B such that the post 12 may be operatively attached to the bracket 40 as previously described, for example, by one or more fasteners 38, 32, to reduce or eliminate the clearance between the post 12 and the bracket 40 to stabilize the top railing, and/or to retain the top railing to the post 12. In another non-limiting example, the opening 70 may be configured to receive a fastener (not shown) to operatively attach the bracket 40 to the post 12. The opening 70 may be configured to receive, attach, and/or support another member, which may be, for example, a decorative or ornamental member such as a finial, cover or cap, or another structural element, for example, a ledge, a shelf, a flower box, a light post etc.

While the best modes for carrying out the invention have been described in detail, those familiar with the art to which this invention relates will recognize various alternative designs and embodiments for practicing the invention within the scope of the appended claims.

The invention claimed is:

1. A bracket for connection to a structural member having a side surface to support an upright member adjacent to the structural member, the bracket comprising:

an attachment portion configured to be parallel to and operatively attached to the side surface;

a cup integral with the attachment portion, the cup including a side portion and a base portion;

the base portion attached to the side portion to at least partially enclose a bottom of the cup;

wherein the attachment portion is attached to the side portion such that the attachment portion and the side portion define a continuous interior perimeter surface;

wherein the attachment portion includes a first fastener opening and a second fastener opening for attaching the bracket to the side surface;

wherein the cup is integral with the attachment portion such that the cup is intermediate the first fastener opening and the second fastener opening;

wherein the cup is configured to receive the upright member in an installed position such that in the installed position:

the base portion is in contact with the upright member;

the interior perimeter surface surrounds an exterior perimeter surface defined by the upright member; and the interior perimeter surface and the base portion cooperate to retain the upright member in a generally parallel orientation with respect to the side surface of the structural member without attaching the upright member to the cup portion.

2. The bracket of claim 1, further comprising:

a first opening defined by the attachment portion and configured to receive an adjustable member;

wherein the adjustable member is adjustable from a first position to a second position; and wherein the adjustable member in the second position is in contact with the upright member and interfaces with the upright member to prevent removal of the upright member from the bracket.

3. The bracket of claim 1, wherein the adjustable member in the second position substantially reduces a clearance between the interior perimeter surface and the exterior perimeter surface of the upright member.

4. The bracket of claim 2, wherein the adjustable member is adjustable from the second position to the first position such that the upright member is removable from the bracket.

5. The bracket of claim 2, further comprising:

a face plate configured to be operatively attached to the upright member;

wherein the face plate is configured to increase shear strength of the upright member in the installed position.

6. The bracket of claim 5, wherein the face plate is made from one of a metal-containing material and a metal-reinforced material.

7. The bracket of claim 5, wherein the face plate including an interface surface defining a recess such that in the second position the adjustable member extends into the recess.

8. The bracket of claim 2, wherein the adjustable member is a fastener including a threaded portion; and wherein the first opening is threaded to operatively engage the threaded portion of the fastener.

9. The bracket of claim 2, further comprising:

an insert operatively attached to the attachment portion;

wherein the insert defines the first opening.

10. The bracket of claim 1, wherein the attachment portion is configured to be flushly mounted to the side surface.

11. The bracket of claim 1, wherein the cup defines a second opening configured for removal of a fluid from the cup.

12. The bracket of claim 1, wherein the interior perimeter surface defines a generally rectangular cross-section of the cup.

13. The bracket of claim 12, wherein:

the upright member includes one of a 4 inch×4 inch post, a 4 inch×6 inch post, and a 6 inch×6 inch post; and the size of the generally rectangular cross-section corresponds to one of a 4 inch×4 inch post, a 4 inch×6 inch post, and a 6 inch×6 inch post such that cup can receive upright member including the one of a 4 inch×4 inch post, a 4 inch×6 inch post, and a 6 inch×6 inch post.

14. The bracket of claim 1, wherein the bracket is made of a metal containing material.

15. The bracket of claim 1, wherein the bracket is made of a polymeric material.

16. The bracket of claim 1, further comprising:

a first opening defined by the cup and configured to receive an adjustable member;

wherein the adjustable member is adjustable from a first position to a second position; and wherein the adjustable member in the second position is in contact with the upright member and interfaces with the upright member to prevent removal of the upright member from the bracket.

17. The bracket of claim 1, further comprising:

a flange attached to the attachment portion and the cup;

wherein the flange is generally orthogonal to the attachment portion.

18. A bracket system for connecting a structural member having a side surface to an upright member adjacent to the structural member, the bracket system comprising:

a bracket including:

an attachment portion configured to be operatively attached to the side surface, wherein the attachment portion is configured to be parallel to the side surface of the structural member;

a cup integral with the attachment portion, the cup including a side portion and a base portion;

the base portion attached to the side portion to at least partially enclose a bottom of the cup;

wherein the attachment portion is attached to the side portion such that the attachment portion and the side portion define a continuous interior perimeter surface;

wherein the attachment portion includes a first fastener opening and a second fastener opening for attaching the bracket to the side surface;

wherein the cup is integral with the attachment portion such that the cup is intermediate the first fastener opening and the second fastener opening;

wherein the cup is configured to receive the upright member in an installed position such that in the installed position:

the base portion is in contact with the upright member;

the interior perimeter surface surrounds an exterior perimeter surface defined by the upright member; and the interior perimeter surface and the base portion cooperate to retain the upright member in a generally perpendicular orientation with respect to the side surface of the structural member without attaching the upright member to the cup portion; and an opening defined by one of the attachment portion and the cup portion of the bracket and configured to receive an adjustable member;

wherein the adjustable member is adjustable from a first position to a second position such the adjustable member in the second position is in contact with an interface surface defined by the upright member;

wherein the adjustable member in the second position sufficiently retains the upright member in the cup portion to resist removal of the upright member from the bracket; and wherein the adjustable member is adjustable from the second position to the first position such that the upright member is removable from the bracket.

19. The bracket system of claim 18, wherein:

the adjustable member is configured as a threaded fastener; and the opening is configured to operatively engage the threaded fastener.

20. The bracket system of claim 18, wherein the upright member comprises a face plate defining the interface surface.

21. The bracket system of claim 20, wherein:

the upright member is made from one of a wood material, a wood composite material, and a polymeric composite material; and the face plate is made from one of a metal-containing material and a metal-reinforced material.

22. The bracket system of claim 18, wherein the upright member comprises a face plate configured as a reinforcement element.

23. A bracket system for connecting a structural member having a side surface to an upright member adjacent to the structural member, the bracket system comprising:

a face plate operatively attachable to a post member to provide an upright member, wherein the face plate is a reinforcement element reinforcing the post member;

a bracket including:

an attachment portion configured to be parallel to and operatively attached to the side surface;

a cup integral with the attachment portion, the cup including a side portion and a base portion;

the base portion attached to the side portion to at least partially enclose a bottom of the cup;

wherein the attachment portion is attached to the side portion such that the attachment portion and the side portion define a continuous interior perimeter surface;

wherein the attachment portion includes a first fastener opening and a second fastener opening for attaching the bracket to the side surface;

wherein the cup is integral with the attachment portion such that the cup is intermediate the first fastener opening and the second fastener opening;

wherein the cup is configured to receive the upright member in an installed position such that in the installed position:

the base portion is in contact with the upright member;

the interior perimeter surface surrounds an exterior perimeter surface defined by the upright member; and the interior perimeter surface and the base portion cooperate to retain the upright member in a generally perpendicular orientation with respect to the side surface of the structural member without attaching the upright member to the cup portion.

* * * * *